US009144733B2

(12) United States Patent
Chou

(10) Patent No.: US 9,144,733 B2
(45) Date of Patent: Sep. 29, 2015

(54) SOCCER BALL DISPENSER

(71) Applicant: Ting-Kuo Chou, Taichung (TW)

(72) Inventor: Ting-Kuo Chou, Taichung (TW)

( * ) Notice: Subject to any disclaimer, the term of this patent is extended or adjusted under 35 U.S.C. 154(b) by 0 days.

(21) Appl. No.: 14/537,917

(22) Filed: Nov. 11, 2014

(65) Prior Publication Data

US 2015/0061222 A1 Mar. 5, 2015

(51) Int. Cl.
*A63F 7/34* (2006.01)
*A63F 7/06* (2006.01)

(52) U.S. Cl.
CPC ..... *A63F 7/0672* (2013.01); *A63F 7/34* (2013.01); *A63F 2007/341* (2013.01); *A63F 2007/343* (2013.01)

(58) Field of Classification Search
CPC ..... A63F 7/0672; A63F 11/00; A63F 7/06; A63F 7/0616; A63F 7/0717; A63F 7/34; A63F 2007/341; A63F 2007/343; A63F 2007/345
USPC ..... 273/127 R, 127 S, 127 T, 108.1, 108.5, 273/108.52, 108.54, 108.55, 108, 118 R, 273/119 R
See application file for complete search history.

(56) References Cited

U.S. PATENT DOCUMENTS

| | | | | | |
|---|---|---|---|---|---|
| 4,025,073 | A * | 5/1977 | Furr et al. | ..... | 273/108.52 |
| 4,173,338 | A * | 11/1979 | Barnett | ..... | 273/108.1 |
| 4,480,833 | A * | 11/1984 | Barcelow et al. | ..... | 273/108.56 |
| 5,350,174 | A * | 9/1994 | Ritchie et al. | ..... | 273/121 A |
| 5,524,887 | A * | 6/1996 | Trudeau et al. | ..... | 273/129 S |
| 5,741,010 | A * | 4/1998 | Weyna | ..... | 273/119 A |
| 5,931,465 | A * | 8/1999 | Miyake et al. | ..... | 273/108.1 |
| 6,402,140 | B1 * | 6/2002 | Wood | ..... | 273/108.1 |
| 8,302,965 | B2 * | 11/2012 | Grant | ..... | 273/108.1 |
| 2001/0033052 | A1 * | 10/2001 | Rossi et al. | ..... | 273/108.1 |
| 2010/0102506 | A1 * | 4/2010 | Grant | ..... | 273/108.1 |
| 2015/0061222 | A1 * | 3/2015 | Chou | ..... | 273/129 S |

* cited by examiner

*Primary Examiner* — Raleigh W Chiu

(57) ABSTRACT

A soccer ball dispenser is provided with a table including a top opening and two opposite inlets; and a pushing device under the table and including a tube communicating with the opening of the table, a slot through the tube, two opposite side openings through the tube, two opposite ramps each communicating one inlet with one side opening, a threaded shaft, a first limit switch, a second limit switch, a sliding sleeve put on the tube and having a notch aligned with the slot, a biasing member secured to the table and the sliding sleeve respectively, a pushing assembly in the tube and including a nut put on the threaded shaft, a link passing through the slot to interconnect the pushing assembly and the nut, and a rod extending out of the nut, and an induction motor operatively connected to the threaded shaft.

1 Claim, 10 Drawing Sheets

SOCCER BALL DISPENSER

BACKGROUND OF THE INVENTION

1. Field of the Invention

The invention relates to ball dispensing devices and more particularly to a soccer ball dispenser.

2. Description of Related Art

A conventional golf ball dispensing device comprising a hollow tube including closed first and second ends and a lumen slightly greater than the diameter of a golf ball; a first hole communicating with the lumen located at a point about a golf ball diameter from the first end and having an opening smaller than the diameter of a golf bal; a second hole communicating with the lumen located at a point substantially opposite to the first hole and having a diameter greater than a diameter of a finger and smaller than the diameter of a golf ball so that an individual may use a finger to urge a golf ball located between the holes against the opening of the first hole to expand the opening and eject the golf ball from the tube; and a spring in the lumen between the closed ends to position a golf ball against the first end between the two holes.

However, the conventional golf ball dispenser suffers from complexity and inoperability. Thus, the need for improvement still exists.

SUMMARY OF THE INVENTION

It is therefore one object of the invention to provide a ball dispenser comprising a table including a top opening and two side inlets; and a pushing device under the table and including a tube communicating with the opening of the table, a slot through the tube, two opposite side openings through the tube, two opposite ramps each communicating one inlet with one side opening, a threaded shaft disposed externally of the tube and under the table, the threaded shaft being adjacent to the slot, a first limit switch disposed on an underside of the table and adjacent to a top of the threaded shaft, a second limit switch disposed under the first limit switch by a predetermined distance, the second limit switch being adjacent to a bottom of the threaded shaft, a sliding sleeve put on the tube and having a notch aligned with the slot, a biasing member having two ends secured to the underside of the table and the sliding sleeve respectively, a pushing assembly disposed in the tube and including an internally threaded nut threadedly put on the threaded shaft, a link passing through the slot to interconnect the pushing assembly and the nut, and a rod extending out of the nut, and a drive source operatively connected to the threaded shaft; wherein in response to a clockwise rotation of the drive source, the threaded shaft clockwise rotates, the nut moves upward along its axis, the link moves upward along the slot and the notch, both the pushing device and the rod move upward, the biasing member compresses, the upward movement is stopped when the link is stopped by an upper end of the slot, the rod contacts the first limit switch which is in turn closed to stop the clockwise rotation of the drive source, the pushing assembly partially passes through the opening of the table, and the side openings are blocked by the sliding sleeve, thereby preventing a ball in any of the ramps from entering the tube; and wherein in response to a counterclockwise rotation of the drive source, the threaded shaft counterclockwise rotates, the nut moves downward along its axis, the link moves downward along the slot and the notch, both the pushing device and the rod move downward, the biasing member expands, the downward movement is stopped when the link is stopped by a lower end of the slot, the rod contacts the second limit switch which is in turn closed to stop the counterclockwise rotation of the drive source, and the side openings are open to allow the ball in any of the ramps to enter the tube to fall onto the pushing assembly.

The above and other objects, features and advantages of the invention will become apparent from the following detailed description taken with the accompanying drawings.

DETAILED DESCRIPTION OF THE INVENTION

Figure 1:
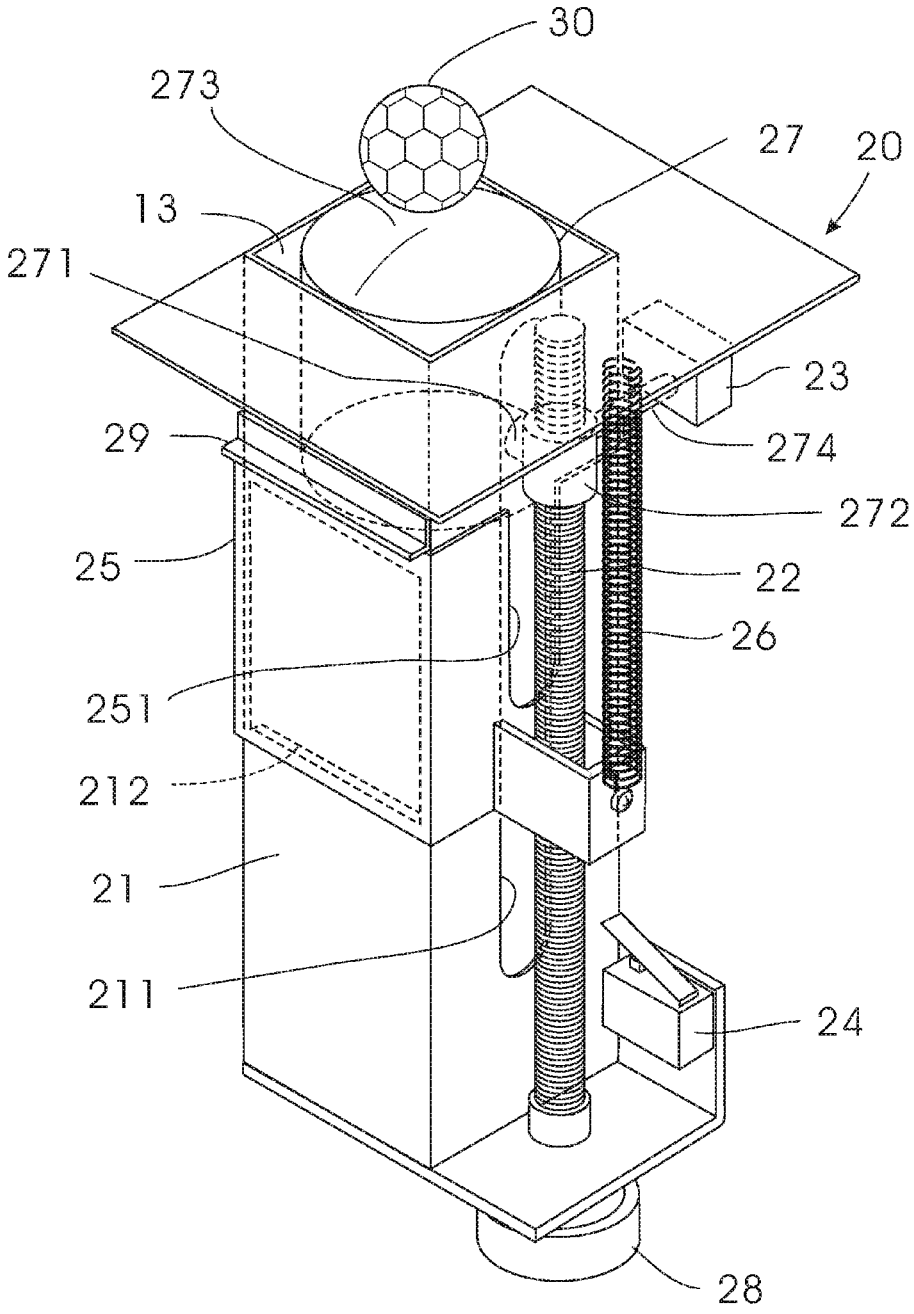
FIG. 1 is a perspective view of a pushing device of a soccer ball dispenser according to the invention.
Figure 2:
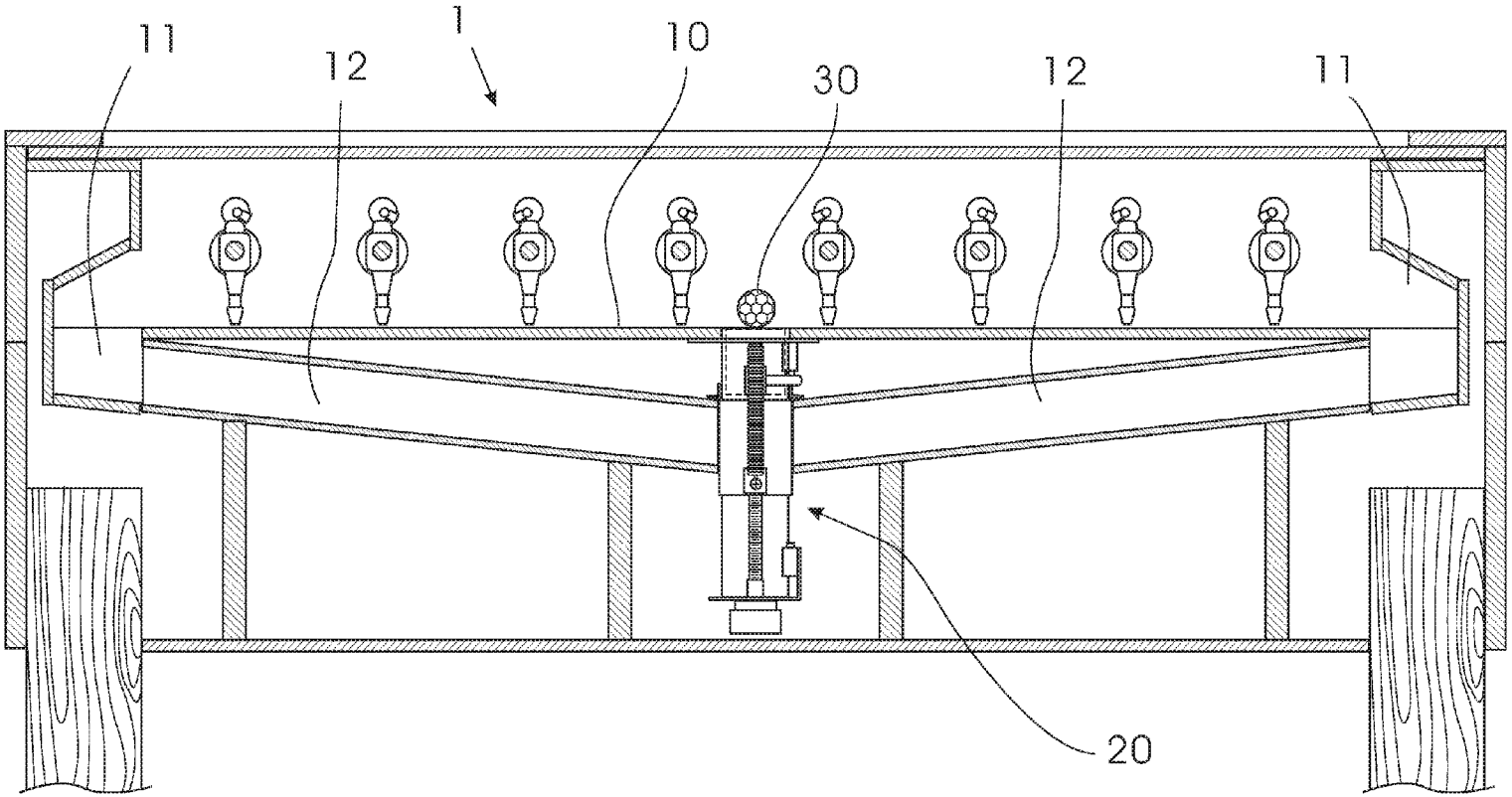
FIG. 2 is a longitudinal sectional view of the soccer ball dispenser.
Figure 3:
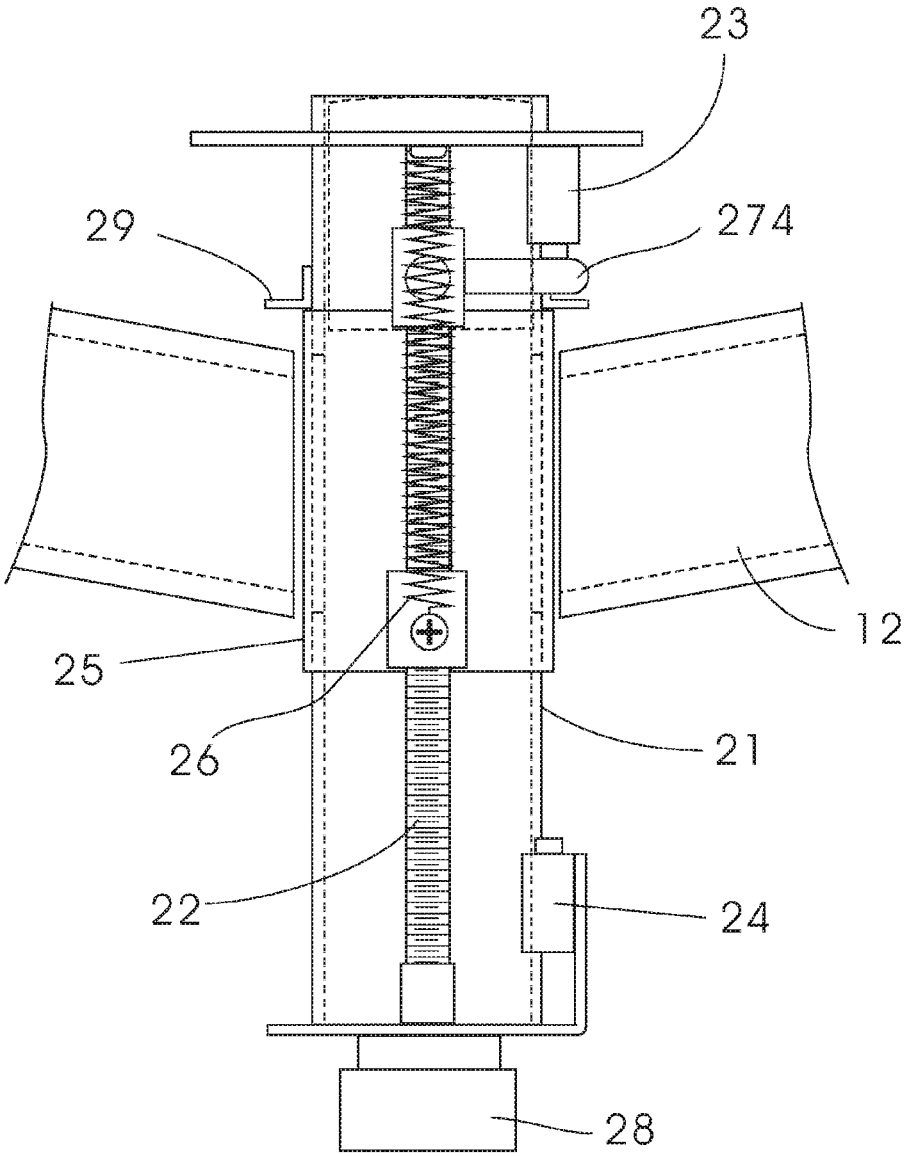
FIG. 3 is an enlarged view of a central portion of FIG. 2.
Figure 4:
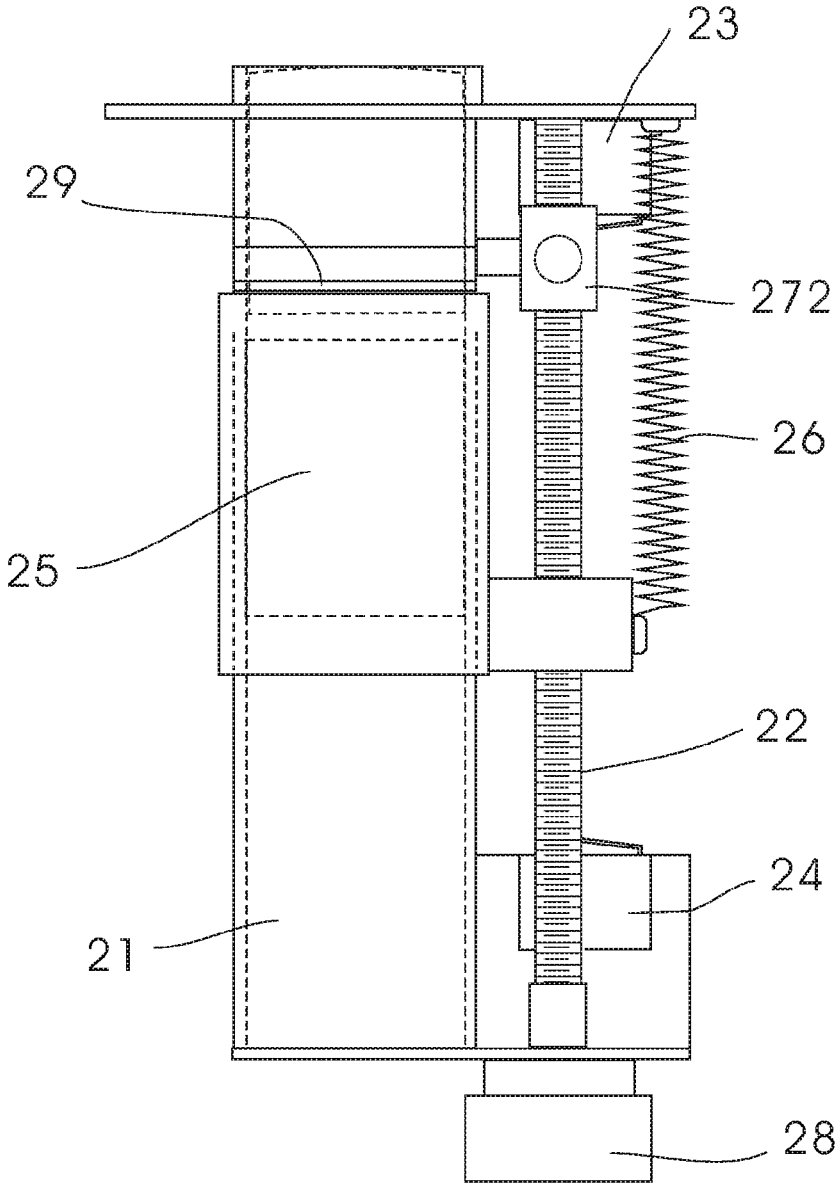
FIG. 4 is a side elevation of FIG. 3.
Figure 5:
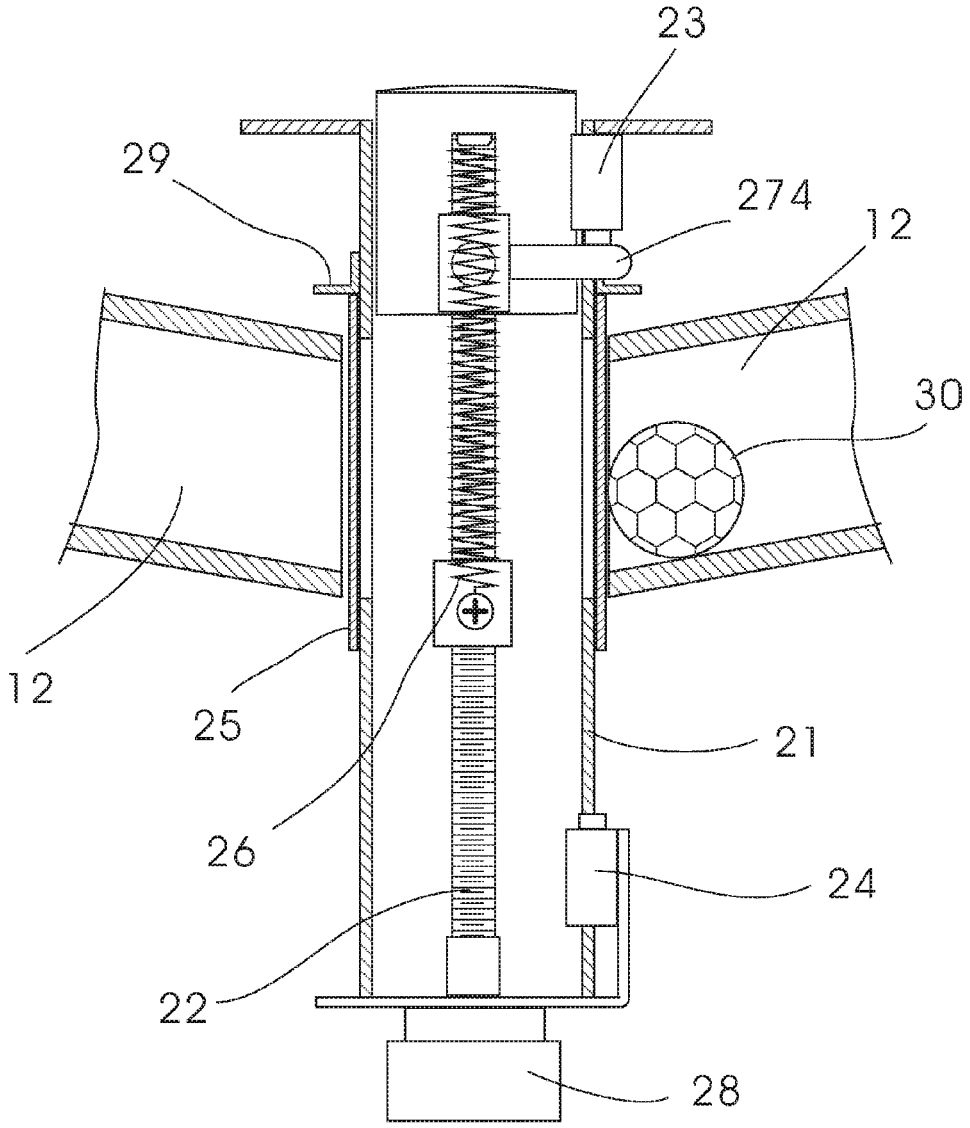
FIG. 5 is a view similar to FIG. 3 showing a soccer ball being stopped by the sliding sleeve.
Figure 6:
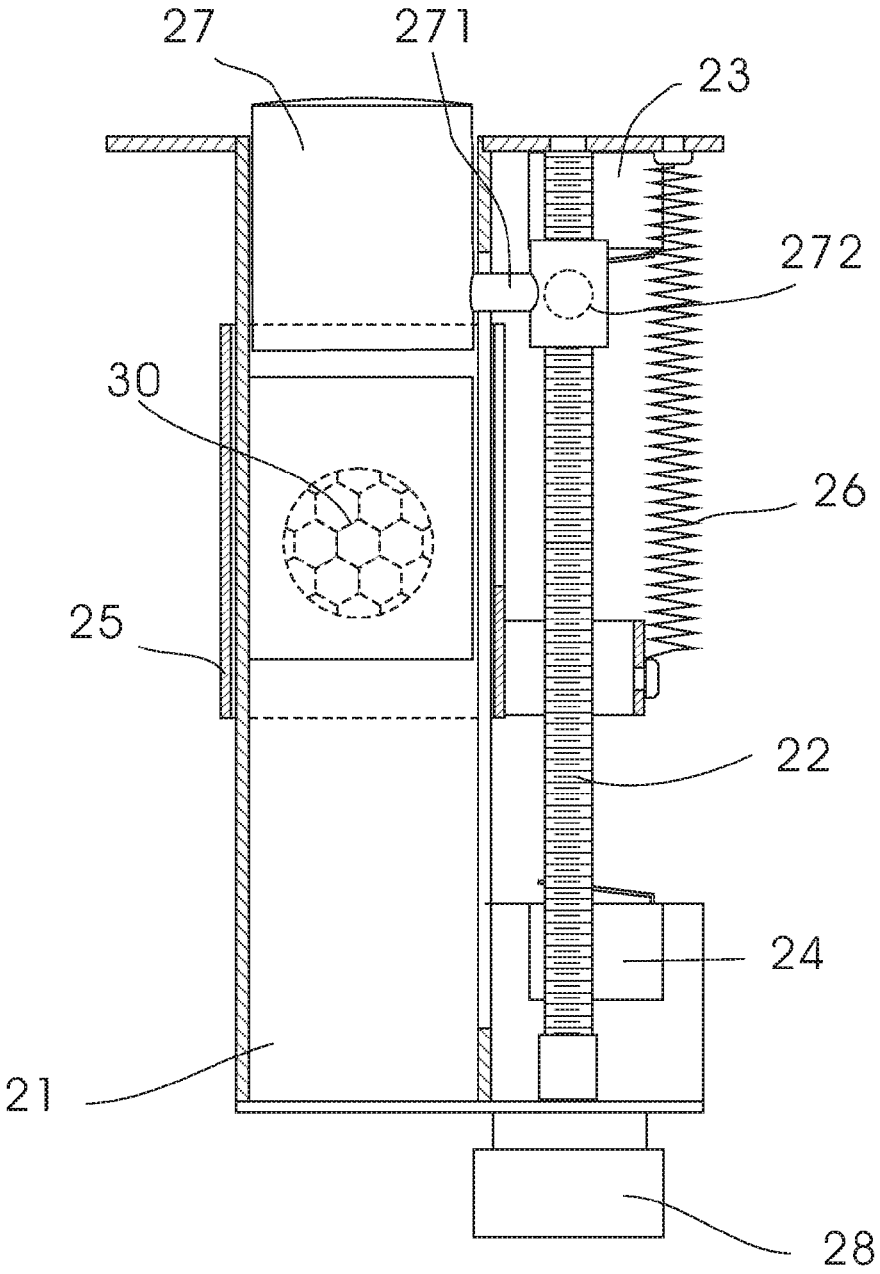
FIG. 6 is a view similar to FIG. 4 showing the soccer ball being stopped by the sliding sleeve with the pushing device moved to its upper limit and the sliding sleeve also moving to its highest point.

Referring to FIGS. 1 to 10, a soccer ball dispenser 1 in accordance with the invention comprises the following components as discussed in detail below.

A table 10 includes two opposite inlets 11. A pushing device 20 is provided under a center of the table 10. Two opposite ramps 12 each interconnect one inlet 11 (or the other inlet 11) and the pushing device 20. The pushing device 20 includes an elongated tube 21 having a rectangular section, the tube 21 having a top opening communicating with an outlet 13 at a center of the table 10, a forward slot 211, and two opposite side openings 212 each communicating with the ramp 12, a threaded shaft 22 provided forward of the tube 21, a first limit switch 23 provided below the table 10 and adjacent to the top of the threaded shaft 22, a second limit switch 24 provided under the table 10 and adjacent to the bottom of the threaded shaft 22, a sliding sleeve 25 put on the tube 21 and having a forward opening 251 aligned with the forward slot 211, a torsion spring 26 having a top secured to the table 10 and a bottom secured to the sliding sleeve 25, a pushing assembly 27 in the tube 21 and including an internally threaded nut 272 put on the threaded shaft 22, a link 271 passing through the slot 211 to interconnect the pushing assembly 27 and the nut 272, a convex top end 273 for supporting a soccer ball 30, and a rod 274 having one end secured to the nut 272, an induction motor 28 beneath the threaded shaft 22 and being operatively connected to the threaded shaft 22, and an upper stop 29 projecting out of an outer surface of the tube 21 for limiting an upward movement of the sliding sleeve 25. Two opposite ramp members 252 each are provided at the side opening 212 in the tube 21.

As shown in FIGS. 3 to 6 specifically, in response to a clockwise rotation of the induction motor 28, the threaded shaft 22 clockwise rotates. And in turn, the nut 272 moves upward along its axis. Also, the link 271 moves upward along the slot 211 and the opening 251 as well as both the pushing device 27 and the rod 274 move upward. The spring 26 compresses during the upward movement. The upward movement will be stopped when the sliding sleeve 25 is stopped by the upper stop 29 and the link 271 is stopped by the upper end of the slot 211. At this stopped position, the rod 274 contacts the first limit switch 23 which is in turn closed to stop the rotation of the induction motor 28. The top 273 is at an elevation greater than that of the table 10, the communication of the ramp 12 and the side opening 212 is blocked by the sliding sleeve 25, thereby preventing a soccer ball 30 in the ramp 12 from entering the tube 21 (i.e., the soccer ball 30 being stopped at the end of the ramp 12 joining the side opening 212 of the tube 21).

Figure 7:
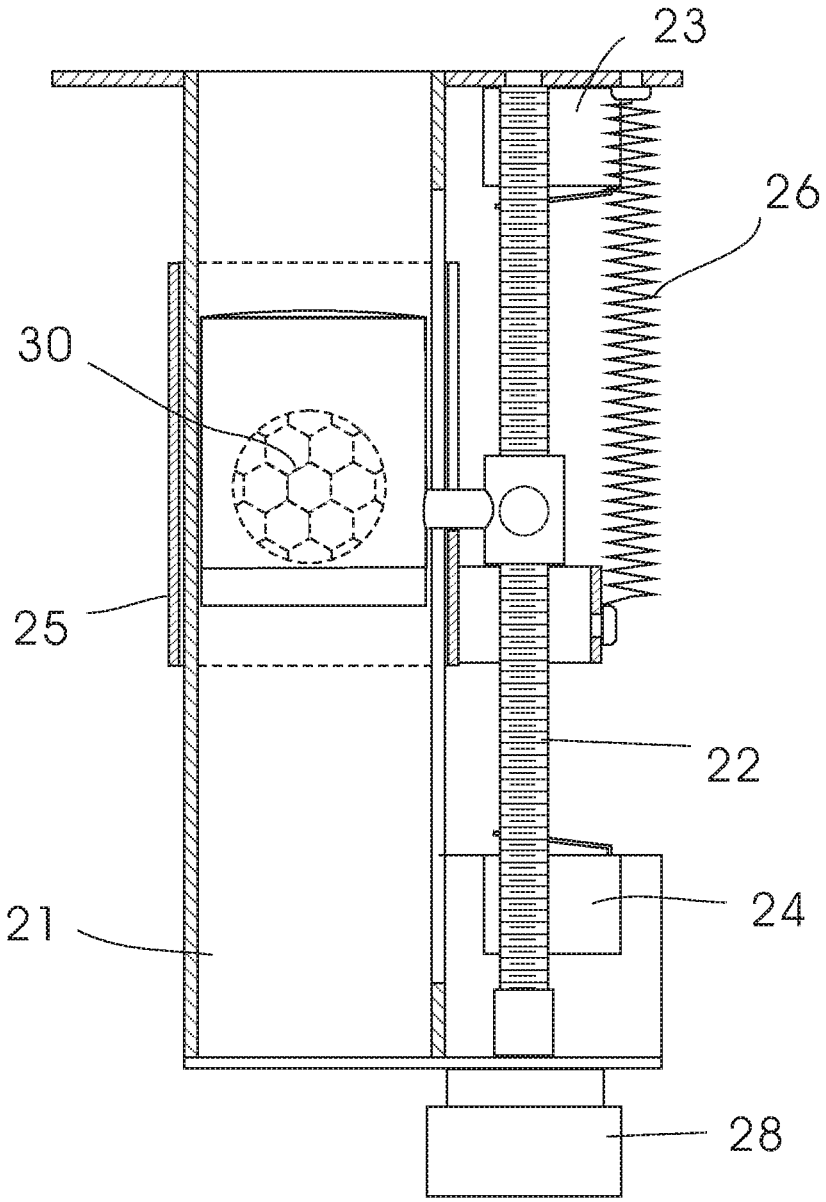
FIG. 7 is a view similar to FIG. 6 showing the pushing device moving downward.
Figure 8:
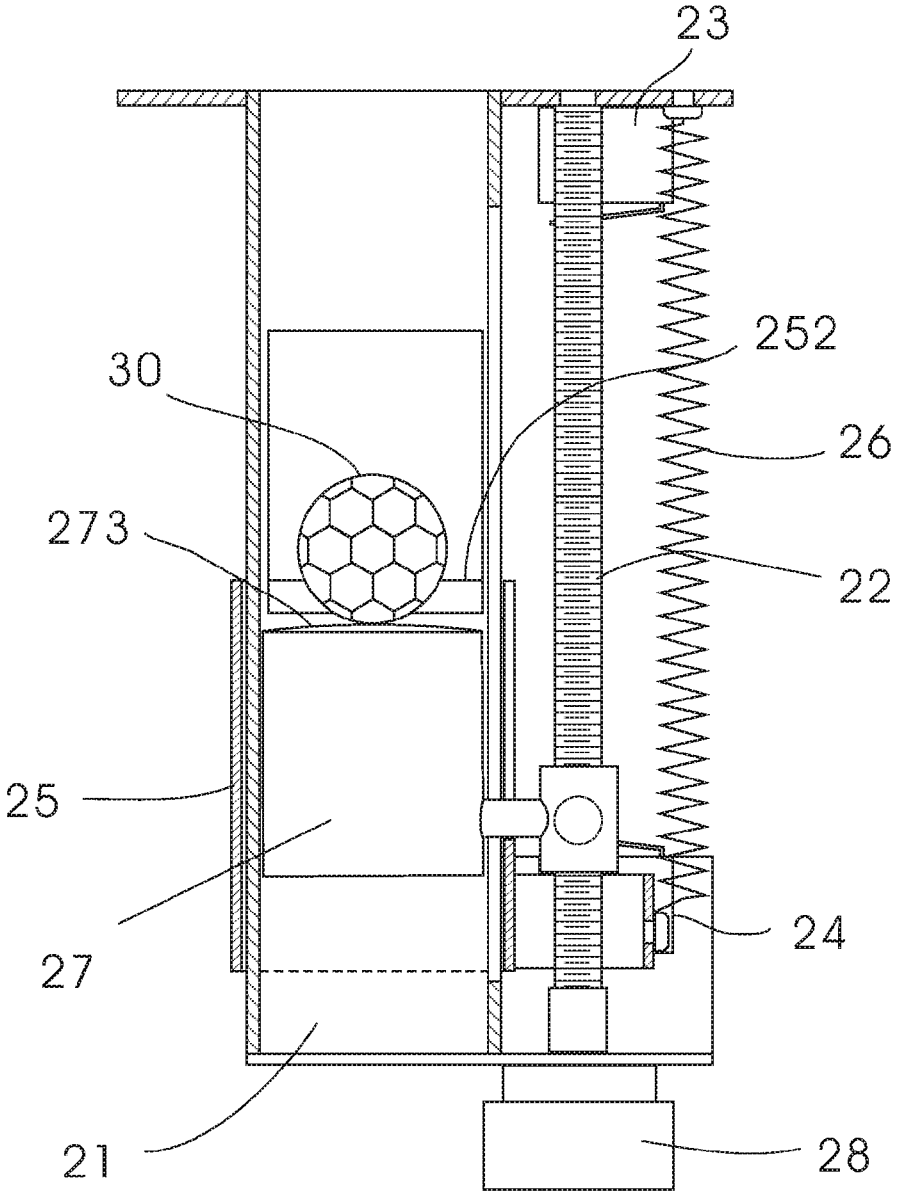
FIG. 8 is a view similar to FIG. 7 showing the pushing device moving to its lower limit, the sliding sleeve also moving to its lowest point, and the soccer ball rested on top of the pushing device.

As shown in FIGS. 7 and 8 specifically, in response to a counterclockwise rotation of the induction motor 28, the threaded shaft 22 counterclockwise rotates. And in turn, the nut 272 moves downward along its axis. Also, the link 271 moves downward along the slot 211 and the opening 251 as well as both the pushing device 27 and the rod 274 move downward. The spring 26 expands during the downward movement. The downward movement will be stopped when the sliding sleeve 25 is stopped by the bottom end of the lower end of the slot 211. At the this stopped position, the rod 274 contacts the second limit switch 24 which is in turn closed to stop the counterclockwise rotation of the induction motor 28. During the downward movement, the side opening 212 is gradually open. The soccer ball 30 in the ramp 12 may enter the tube 21 via the ramp member 252 to fall onto the top 273 if the side opening 212 is sufficiently open to allow the soccer ball 30 to pass.

Figure 9:
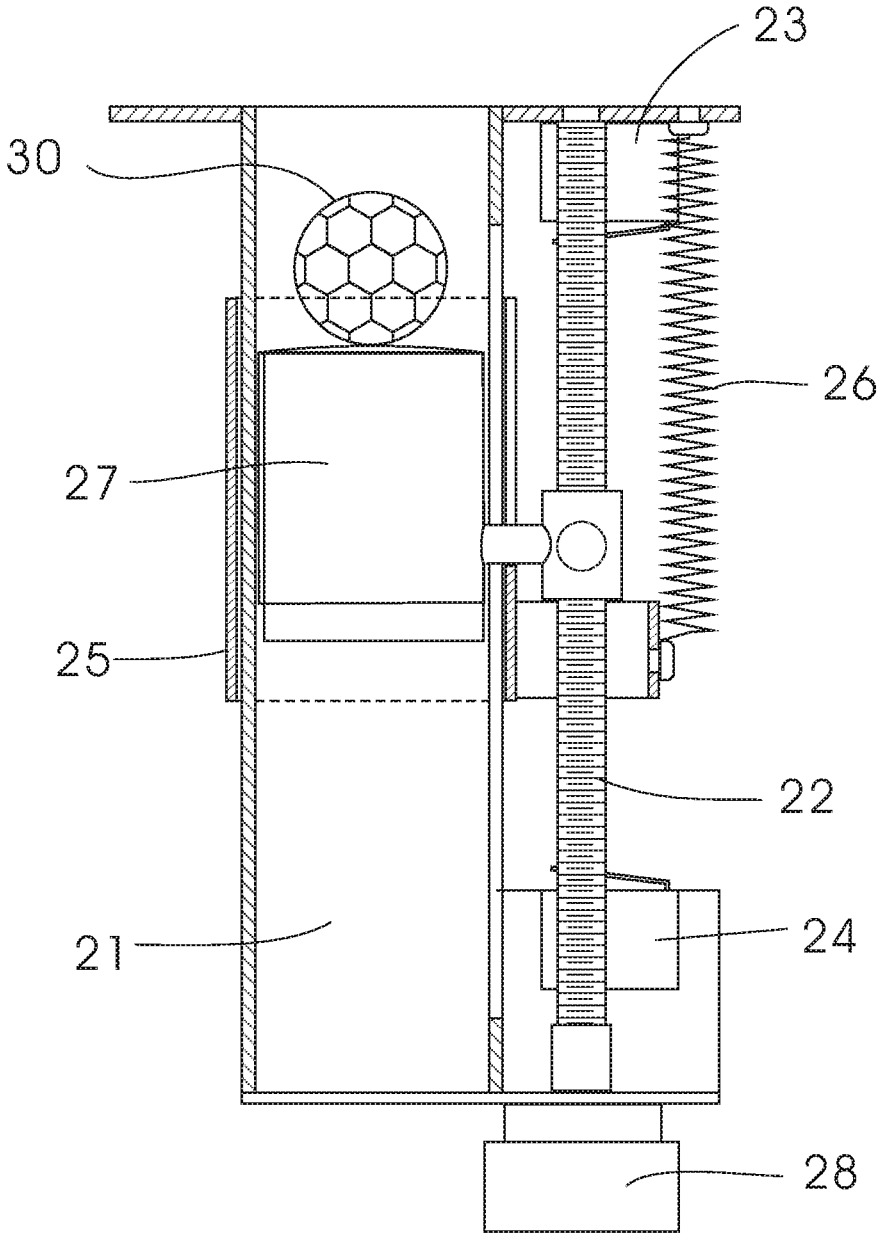
FIG. 9 is a view similar to FIG. 8 showing the pushing device moving upward.
Figure 10:
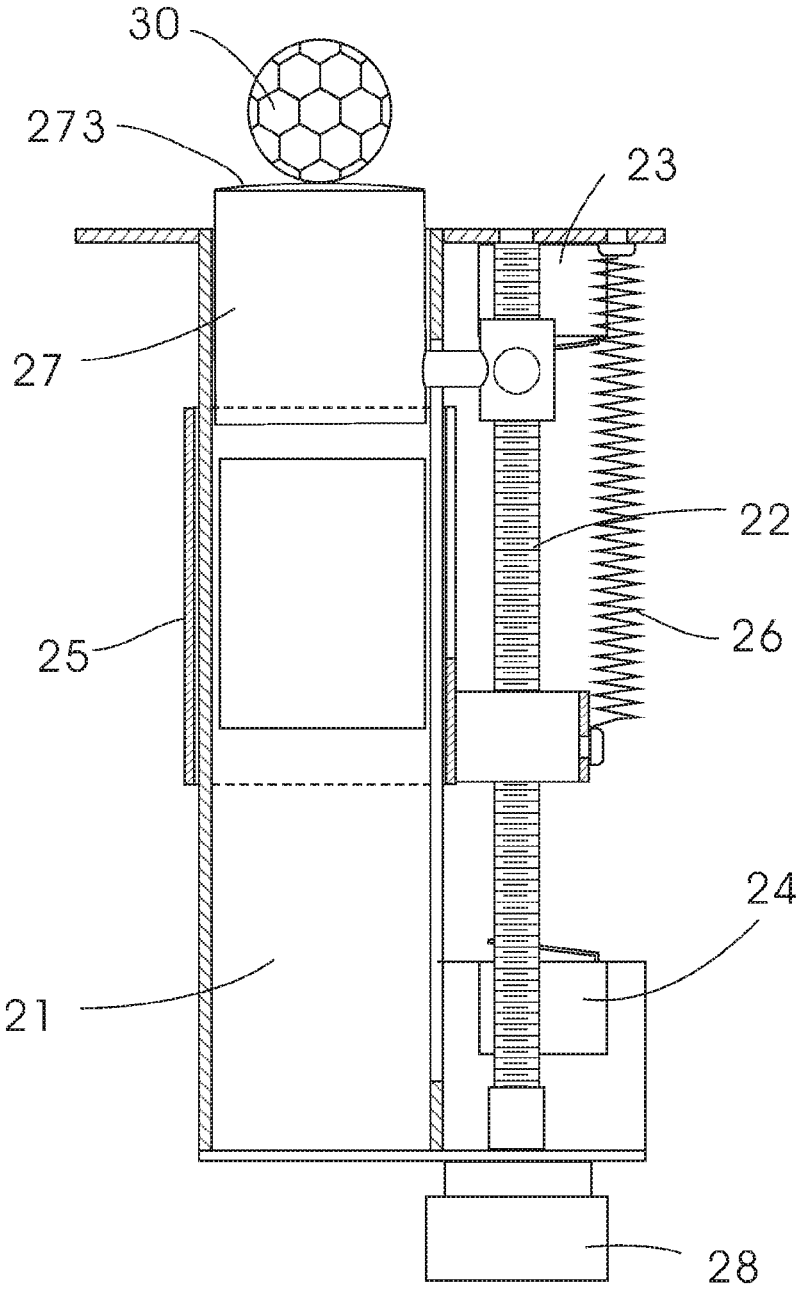
FIG. 10 is a view similar to FIG. 9 showing the pushing device moving to its upper limit, the sliding sleeve also moving to its highest point, and the soccer ball is exposed to be ready to deliver.

As shown in FIGS. 9 and 10 specifically, in response to a clockwise rotation of the induction motor 28, the threaded shaft 22 clockwise rotates. And in turn, the nut 272 moves upward along its axis. Also, the link 271 moves upward along the slot 211 and the opening 251 as well as both the pushing device 27 and the rod 274 move upward. The spring 26 compresses during the upward movement. The upward movement will be stopped when the sliding sleeve 25 is stopped by the upper stop 29 and the link 271 is stopped by the upper end of the slot 211. At this stopped position, the rod 274 contacts the first limit switch 23 which is in turn closed to stop the rotation of the induction motor 28. The top 273 is at an elevation greater than that of the table 10, the communication of the ramp 12 and the side opening 212 is blocked by the sliding sleeve 25. The soccer ball 30 on the top 273 is finally exposed to be picked by a player.

While the invention has been described in terms of preferred embodiments, those skilled in the art will recognize that the invention can be practiced with modifications within the spirit and scope of the appended claims.

What is claimed is:

1. A ball dispenser comprising:

a table including an opening on a top and two opposite inlets on two sides respectively; and a pushing device disposed under the table and including a tube communicating with the opening of the table, a slot formed through the tube, two opposite side openings formed through the tube with the slot disposed therebetween, two opposite ramps each communicating one of the inlets with one of the side openings, a threaded shaft disposed externally of the tube and under the table, the threaded shaft being adjacent to the slot, a first limit switch disposed on an underside of the table and adjacent to a top of the threaded shaft, a second limit switch disposed under the first limit switch by a predetermined distance, the second limit switch being adjacent to a bottom of the threaded shaft, a sliding sleeve put on the tube and having a notch aligned with the slot, a biasing member having two ends secured to the underside of the table and the sliding sleeve respectively, a pushing assembly disposed in the tube and including an internally threaded nut threadedly put on the threaded shaft, a link passing through the slot to interconnect the pushing assembly and the nut, and a rod extending out of the nut, and a drive source operatively connected to the threaded shaft;

wherein in response to a clockwise rotation of the drive source, the threaded shaft clockwise rotates, the nut moves upward along its axis, the link moves upward along the slot and the notch, both the pushing device and the rod move upward, the biasing member compresses, the upward movement is stopped when the link is stopped by an upper end of the slot, the rod contacts the first limit switch which is in turn closed to stop the clockwise rotation of the drive source, the pushing assembly partially passes through the opening of the table, and the side openings are blocked by the sliding sleeve, thereby preventing a ball in any of the ramps from entering the tube; and wherein in response to a counterclockwise rotation of the drive source, the threaded shaft counterclockwise rotates, the nut moves downward along its axis, the link moves downward along the slot and the notch, both the pushing device and the rod move downward, the biasing member expands, the downward movement is stopped when the link is stopped by a lower end of the slot, the rod contacts the second limit switch which is in turn closed to stop the counterclockwise rotation of the drive source, and the side openings are open to allow the ball in any of the ramps to enter the tube to fall onto the pushing assembly.

* * * * *